US006718600B1

(12) United States Patent
Gillis

(10) Patent No.: US 6,718,600 B1
(45) Date of Patent: Apr. 13, 2004

(54) REMOVABLE FASTENER

(75) Inventor: Robert E. Gillis, 224 Walnut St., Menlo Park, CA (US) 94025

(73) Assignee: Robert E. Gillis, Menlo Park, CA (US)

( * ) Notice: Subject to any disclaimer, the term of this patent is extended or adjusted under 35 U.S.C. 154(b) by 0 days.

(21) Appl. No.: 10/255,904

(22) Filed: Sep. 25, 2002

(51) Int. Cl.[7] ..... A44B 21/00; B42F 1/00

(52) U.S. Cl. ..... 24/459; 24/3.13; 24/590.1; 24/591.1; 24/572.1; 24/663; 135/119; 135/120.1

(58) Field of Search ..... 24/459, 460, 517, 24/457, 518, 296, 295, 590.1, 663, 591.1, 3.13; 135/119, 120.1

(56) References Cited

U.S. PATENT DOCUMENTS

| | | | | | |
|---|---|---|---|---|---|
| 1,209,783 | A | * | 12/1916 | Van Horn | 24/590.1 |
| 2,302,341 | A | | 11/1942 | Nash | |
| 2,693,014 | A | * | 11/1954 | Monahan | 24/572.1 |
| 3,283,383 | A | | 11/1966 | Heath | |
| 3,530,550 | A | * | 9/1970 | White | 24/464 |
| 3,913,186 | A | * | 10/1975 | Ray et al. | 24/459 |
| 4,175,305 | A | | 11/1979 | Gillis | |
| 4,308,647 | A | | 1/1982 | Gillis | |
| 4,527,760 | A | * | 7/1985 | Salacuse | 248/108 |
| 4,905,354 | A | * | 3/1990 | Smith | 24/590.1 |
| 5,511,289 | A | * | 4/1996 | Melia | 24/66.9 |
| 5,940,942 | A | * | 8/1999 | Fong | 24/459 |

OTHER PUBLICATIONS

Canvas fastener, twist stud fastener dual base, from West Marine Products on–line catalog at http://www.westmarine.com (2002).

* cited by examiner

*Primary Examiner*—Victor Sakran
(74) *Attorney, Agent, or Firm*—Townsend and Townsend and Crew LLP

(57) ABSTRACT

A fastener is provided for removably engaging and holding sections of material, such as a tarp, without piercing the material. One piece of the fastener is a base with one end providing a contact surface for a support structure, and the other forming a substantially elliptical flange. The second piece is a frame having an opening that substantially defines a first ellipse having a first orientation, and a second ellipse having a second orientation. The second elliptical opening is partially occluded at its opposite ends. A section of material to be engaged and held is placed over the elliptical flange. The second piece is oriented to align the first elliptical opening and the elliptical flange, and is inserted over the elliptical flange and section of material to be held. The second piece is then rotated to align the second elliptical opening and elliptical flange. In this position, the occlusions of the second elliptical opening and the ends of the elliptical flange prevent disengagement of the two pieces and hold the section of material therebetween without piercing it.

30 Claims, 3 Drawing Sheets

REMOVABLE FASTENER

BACKGROUND OF THE INVENTION

1. Field of the Invention

The present invention relates to fasteners for use with flexible materials, such as tarps, tent material, and the like. More specifically, the invention relates to fasteners which are temporary and removable, and even more specifically to fasteners which engage a material without puncturing it.

2. Description of Related Art

Over the years, a number of fasteners have been developed for engaging and gripping flexible material, such as tent fabric or a tarp, and connecting it to a structural element, such as a pole. Many such fasteners have been developed specifically for constructing shelter structures, such as tents.

A number of problems have surfaced with known fasteners. Some such fasteners require piercing the material to be engaged in order to function properly. Piercing the material to be engaged and held is undesirable because it tends to weaken the material structurally, and also tends to increase the risk of leakage. Such fasteners obviously have drawbacks in applications requiring protection from the elements and in certain weather conditions, such as high winds and rain.

The present inventor has developed a number of fasteners that do not require piercing the material to be engaged and held. One such fastener, marketed under the name GripClip™, is shown and described in U.S. Pat. Nos. 4,308,647 and 4,175,305. Other such fasteners are shown and described in varying degrees of detail in various tent applications in the inventor's U.S. Pat. Nos. 3,986,519; 4,099,533; 4,265,260; 4,265,259; 4,414,993; 4,809,726; and 4,944,322.

The present inventor's previous non-piercing fasteners have certain common characteristics. Each such fastener comprises two pieces. Typically, one piece is positioned on one side of a section of material to be engaged, and the other is positioned on the opposite side. One of the pieces is then tipped and urged completely through an opening in the other piece, with the material between them. The two pieces are sized and shaped such that by turning, twisting, or otherwise positioning the first piece the two pieces become temporarily "locked" together with the material engaged between them. By reversing the process the material can be released. At least one of the pieces is provided with structure to fasten to a pole or other structural element via a length of cord or the like.

Although the present inventor's non-piercing fasteners are completely suitable for the applications for which they were designed, and to which they have been put, they do have certain structural characteristics that may limit their use in some applications. For example, the inventor's previous fasteners require the ability for one piece of the fastener to be tipped and then inserted completely through an opening or the like in a second piece of the fastener in order to engage and hold the material. This presents no difficulty when applied to tent structures, for example, because the area behind the second piece is typically open and unrestricted, permitting free movement of the first piece completely through the opening in the second. However, in some applications, such open and unrestricted space may not be available or may not exist. One example would be in a construction application, such as a roofing application. In that application, it may be desirable for the second piece of the fastener to be secured to a rigid structure, such as the roof, at least temporarily. In that application, there may be insufficient open space to permit the first piece of the fastener to be inserted completely through the second piece in order to engage and hold the material.

Thus, there is a need for a fastener embodying the positive characteristics of prior fasteners, such as the ability to engage and hold flexible material without piercing it, while also overcoming certain structural and other limitations of previous fasteners. The present invention provides such a fastener.

Accordingly, it is an object of the present invention to provide a fastener that can engage and hold a section of flexible material without piercing the material.

It is also an object of the invention to provide such a fastener that can engage and hold the material in applications where there is insufficient space to insert a first piece completely through a second piece of the fastener.

It is a further object of the invention to provide such a fastener which is suitable for fastening to a rigid structure, either temporarily or permanently, without impairing the ability of the fastener to engage and hold a section of material.

SUMMARY OF THE INVENTION

The present invention provides the foregoing and other advantages, which will become clear from a consideration of the following detailed description of the preferred embodiments, together with the drawings. In summary, the invention comprises a removable fastener for holding a section of material. The fastener has a base with a first surface, which may abut a support stucture, and a geometrically-shaped protrusion, which may comprise a substantially elliptical flange, and which is spaced from the first surface. The fastener also has a frame with a geometrically-shaped opening, which may be a first substantially elliptical opening having a first orientation. The protrusion is free to pass at least partially through the opening when the base and frame are in a first orientation wherein the protrusion and the opening are aligned. However, when the base and frame are in a second orientation in which the protrusion and opening are not aligned, the protrusion is blocked from passing through the opening. Thus, the frame and base may be removably coupled together. When a section of material is placed between the frame and base, the frame and base removably hold the material therebetween without piercing the material.

According to another feature of the invention, the opening comprises a second substantially elliptical opening which has a second orientation from the first substantially elliptical opening. The second elliptical opening has a partial occlusion, preferably at opposite elongate ends thereof. According to this feature of the invention, the protrusion is free to pass through the opening when the base and frame are in a first orientation in which the protrusion and first elliptical opening are aligned, but is blocked from passing through the opening when the frame and base are in a second orientation in which the protrusion is aligned with the second elliptical opening. The first and second elliptical openings may be concentric, and the occlusion may comprise a contiguous portion of the frame itself.

According to another aspect of the invention, the first surface of the base may be provided with facilities to affix the base to a support structure. For example, the first surface may be provided with one or more spikes to affix the base to a support structure.

According to yet another aspect of the invention, the frame may be provided with facilities to connect it to other structures, such as guide lines, tensioning lines, or the other structures.

DETAILED DESCRIPTION OF THE PREFERRED EMBODIMENTS

Referring now to the figures, a detailed description of a presently preferred embodiment of the invention is provided. This description is intended to be exemplary in nature and not to limit the scope of the invention, unless expressly indicated otherwise.

Figure 1:
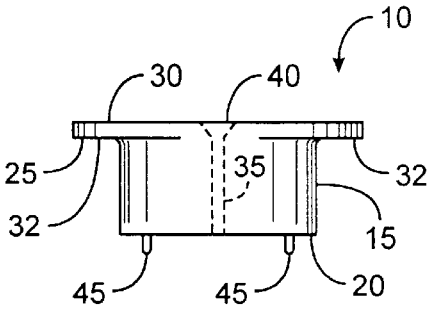
FIG. 1 is a side elevation view of a first portion of a preferred fastener comprising a base.
Figure 2:
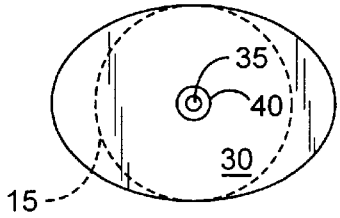
FIG. 2 is a top plan view of the base shown in FIG. 1.
Figure 3:
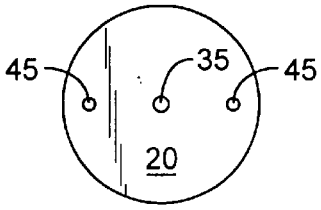
FIG. 3 is a bottom plan view of the base shown in FIG. 1.

Referring to FIGS. 1-3, a first portion of a presently preferred fastener according to the invention comprises a base 10. Base 10 may be formed in any suitable manner, one suitable manner being a molding process, another being a machining process, or a combination of both. Preferably the material selected for base 10 will be resistant to physical damage as well as to the elements. Many plastics meet these criteria, are moldable, and are suitable for use.

In its presently preferred form, base 10 has a substantially cylindrically-shaped body 15. Body 15 has a first substantially flat surface 20 at one end, which is adapted to contact a support structure, as shown in further detail in FIG. 7. A substantially elliptical flange 25 is formed at the opposite end of body 15 and preferably extends beyond the boundary of body 15 as shown in FIG. 2. Preferably elliptical flange 25 has a substantially flat top surface 30 and a bottom surface 32.

Figure 7:
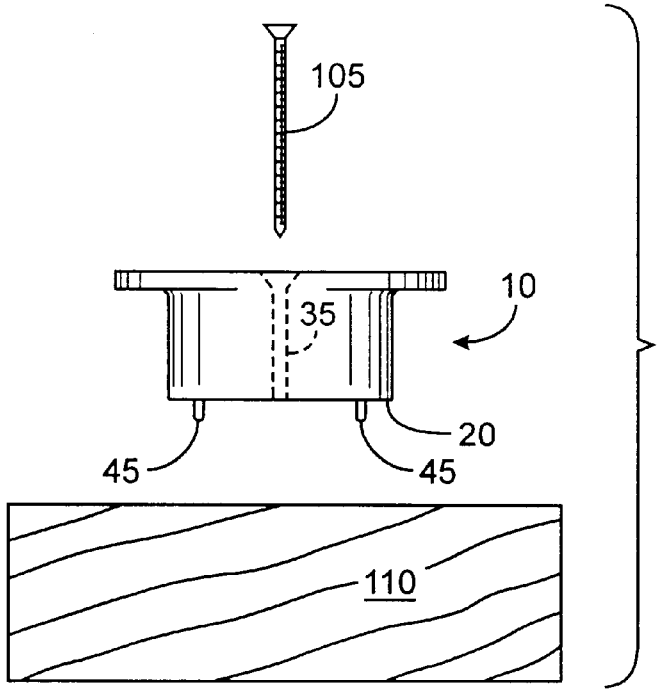
FIG. 7 is an exploded view showing how the base of FIG. 1 is adapted to be affixed to a support structure.

To facilitate affixing base 10 to a support structure, a through hole or shaft 35 may be provided. If provided, the through hole 35 preferably extends completely through the base 10 from the surface 30 to the surface 20. Through hole 35 may be formed in any suitable manner, including by drilling. Through hole 35 is intended to accommodate a screw or other fastener, which preferably will pass through base 10 and into a support structure, as shown in FIG. 7. Preferably the through hole 35 has a countersink or bevel 40 on the top surface 30 of elliptical flange 25 so that the head of whatever fastener may be used will be at least flush with or below the level of the top surface 30 to minimize the risk of piercing the material to be engaged and held.

Also preferably provided on the surface 20 are one or more small, short spikes 45. These small spikes may be integrally formed or may simply be press fit into the base 10, particularly if it is made of plastic. The purpose of the spikes is to assist in affixing the base 10 to a support structure by preventing the base from rotating on the structure once affixed. To accomplish this, the spikes 45 should suitably be made of a material that is hard enough to penetrate the support structure when the base is affixed to it. For example, in one application where the support structure is lumber, small metal or plastic spikes have been found suitable. To prevent rotation of the base 10 on the support structure, the spikes are preferably spaced from the opening of the through hole 35 in the surface 20.

In one preferred embodiment, the body 15 is approximately ¾" high and has a diameter of approximately 1¼". The thickness of the elliptical flange 25 is approximately ⅛" with a maximum length of approximately 2" and a maximum width of approximately 1¼", coincident with the diameter of the body 15. However, these dimensions are merely exemplary and different dimensions, both absolute and relative, may be necessary or desirable depending upon the particular intended application for a fastener embodying the invention. For example, in order to engage and hold larger sections of material, it may be necessary or desirable to enlarge the body and the elliptical flange. Additionally, to provide more space or clearance between a support structure and the material to be held, it may be necessary or desirable to lengthen the body 15.

While the body 15 of a preferred base 10 has been described as being substantially cylindrically-shaped, and the flange 25 as being substantially elliptically-shaped, it is understood that many other geometric shapes would also be suitable and still accomplish the same objective and provide the same advantages. Thus, the particular selection of shapes is not intended to be limiting of the invention. For example, any number of other geometrically-shaped protrusions could be substituted for elliptical flange 25, including but not limited to circular, hexagonal or octagonal-shaped protrusions, and even irregular-shaped protrusions. However, shapes with smooth profiles and edges are most preferred in order to minimize the possibility of piercing a section of material to be engaged and held. Moreover, the particular thickness of the geometrically-shaped protrusion may be varied from a thin flange to a substantially thicker dimension, depending upon the depth of the opening of a corresponding frame element (described in connection with FIGS. 4–6 below), the thickness of the material to be held, and the desired amount of "snugness" or "play" between the base 15 and the frame, among other parameters.

Figure 4:
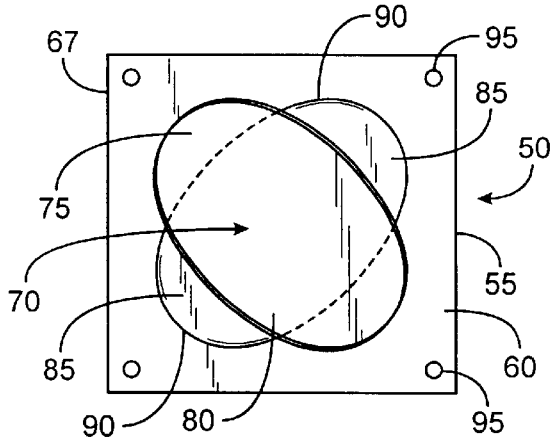
FIG. 4 is a top plan view of a second portion of a preferred fastener comprising a frame.
Figure 5:
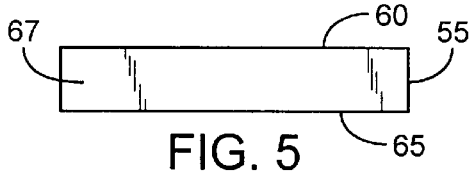
FIG. 5 is a side elevation view of the frame shown in FIG. 4.
Figure 6:
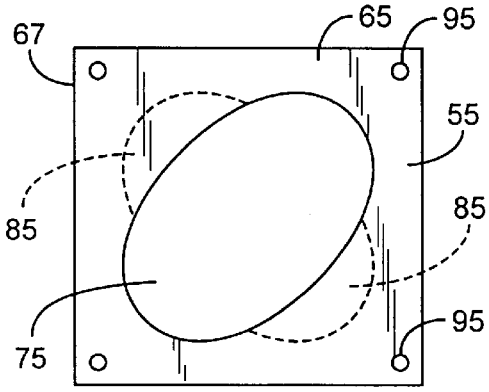
FIG. 6 is a bottom plan view of the frame shown in FIG. 4.

Referring now to FIGS. 4–6, a second portion of a presently preferred fastener embodying the invention comprises a frame 50. Frame 50 may be suitably made of the same material as base 10 and in the same manner. In a presently preferred embodiment, frame 50 has a substantially square outer frame 55 with a first surface 60, a second opposite surface 65, nd exterior sidewalls 67. A geometrically-shaped opening 70 is formed interior to the outer frame 55.

Opening 70 preferably defines a first substantially elliptical opening 75, which extends completely through the entire thickness of the frame, and which preferably has a first orientation. The opening 75 is preferably shaped to correspond to the shape of the flange 25 of base 15. The opening 75 is preferably dimensioned to be slightly larger than the flange 25 so that the flange 25 is free to pass through the opening 75 when it is aligned with the opening 75. The amount by which the opening 75 is made larger than the flange 25 depends on the thickness of the material to be held by the fastener. The opening 75 should be dimensioned larger than the flange 25 by an amount which will permit the flange 25 and the material surrounding it to pass through the opening 75.

The opening 70 also preferably defines a second substantially elliptical opening 80, which preferably has a second orientation. In a presently preferred embodiment, second elliptical opening 80 may be oriented such that its longitudinal axis is perpendicular to the longitudinal axis of the first elliptical opening 75. Second opening 80 is also preferably shaped to correspond to the shape of the flange 25 of base 15 and is preferably dimensioned to be slightly larger than the flange, substantially the same as described with respect to the first opening 75. However, unlike first opening 75, at least a portion of second opening 80 does not extend completely through the frame but rather has a partial occlusion 85. Partial occlusion 85 is preferably located near opposite longitudinal ends of second opening 80. Partial occlusion 85 may be suitably formed either as an integral part of the frame by molding or machining, or may be added to partially block the second opening. Partial occlusion 85 prevents flange 25 from passing though opening 70 when flange 75 and second opening 80 are aligned. In that condition, partial occlusion 85 engages the lower surfaces 32 of the flange 25 and prevent the flange 25 from passing through the opening 70. In the presently preferred embodiment, the occlusion 85 blocks-only a portion of the depth of the second opening 80. As a result, when flange 25 is aligned with the second opening, it can be "seated" in the frame and prevented from twisting or turning by contact with the interior sidewalls 90 of the frame itself.

If desired, the outer frame 55 may be provided with a number of small through holes 95, for example near opposite corners as shown. These through holes can be easily formed by drilling or any other suitable means. The through holes 55 facilitate coupling the frame to another structure, for example a guide line or tensioning line. For example, a small section of cord (not shown) may have its opposite ends fed through holes at opposite corners of the frame. By knotting each of the ends of the cord, a loop is formed, which can then be connected to an aforementioned structure in any suitable fashion. Alternatively, small holes, eyelets, or similar structures, including an integrally-formed handle, could be provided in place of through holes.

In a presently preferred embodiment, the frame has a thickness of approximately 7/16" and each of the sides of the frame is approximately 2½" long. The partial occlusion is approximately ⅛" thick. The first and second substantially elliptical openings have a maximum length of about 2¼" and a maximum width of about 1½". The partial occlusion at the opposite longitudinal ends of the second elliptical opening extend into the opening by about ¾". However, these dimensions are merely exemplary and different dimensions, both absolute and relative, may be necessary or desirable depending upon the particular intended application for a fastener embodying the invention. For example, the thickness and exterior dimensions of the frame, the depth and dimensions of the openings and the thickness of the partial occlusion may all be varied depending upon a variety of factors and desired applications, including but not limited to the size and thickness of the material to be held, the relative size of the base and its geometric protrusion, e.g., flange, and the degree of "snugness" or "play" required or desired between the base and the frame, among other things.

Although the presently preferred embodiment of the frame is described as being approximately square with substantially elliptically-shaped first and second openings, such details are not intended to limit the scope of the invention, which can be carried out with frames having numerous other shapes. For example, the frame itself may be rectangular, round, elliptical, or any number of other shapes considering the stated objectives and advantages of the invention. Similarly openings may well take any number of alternative shapes corresponding to the shape of the flange 25 or other geometrically-shaped protrusion of the base 10.

Still further, a single first opening may be employed in some applications in place of the first and second openings. In such an alternative embodiment, the functions of the second opening and partial occlusion thereof would be provided by the top surface 60 of the frame itself, which would engage and prevent the flange 25 or other geometrically-shaped protrusion of the base 10 from passing through the first opening 75 when the flange 25 and first opening 75 are not aligned. While such a structure would be simpler to manufacture, however, it may not necessarily provide the "seating" characteristic of the second opening, as described above.

A preferred method of use of the preferred fastener is shown in FIGS. 7, 8, and 9A–9C. As shown in FIG. 7, the base 10 is affixed to a support structure 110 by passing a screw 105 or similar fastener through through hole 35 and into the support structure 110 so that surface 20 comes into contact with a corresponding surface of the support structure. Small spikes 45 on the surface 20 of the base 10 also enter the support structure and assist in preventing the base from twisting or turning about screw 105.

Figure 8:
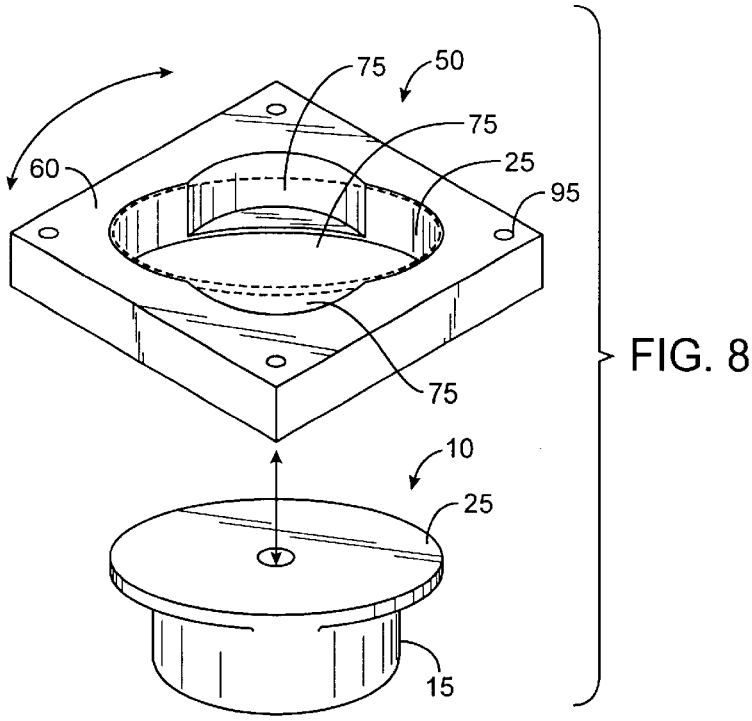
FIG. 8 is a perspective view showing how the frame shown in FIGS. 4–6 and the base shown in FIGS. 1–3 fit together in first and second orientations.

As shown, in FIG. 8, the frame 50 and base 10 are first oriented so that the first opening 70 and the flange 25 are aligned. The frame 50 is then placed over the base 10 so that the flange 25 passes through the first opening 70. The frame 50 is then rotated to a second orientation relative to the frame such that the flange 25 is aligned with the second opening 75. In this position, the flange is able to be "seated" in the frame and is prevented from passing through the opening. The frame and base are removably coupled. To uncouple the frame and base the operations are simply reversed.

Figure 9A:
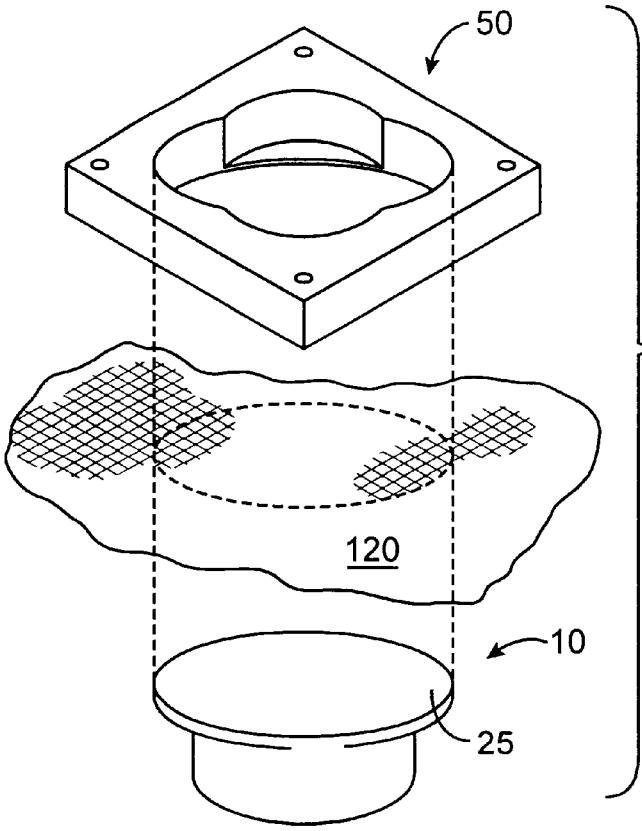
FIGS. 9A–9C are a series of perspective views showing how a fabric is removably engaged and held by the preferred fastener embodying the invention.
Figure 9B:
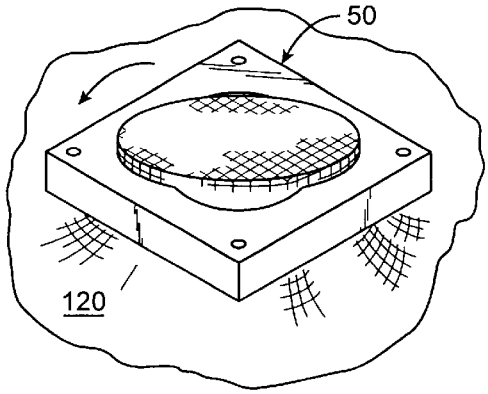
Figure 9C:
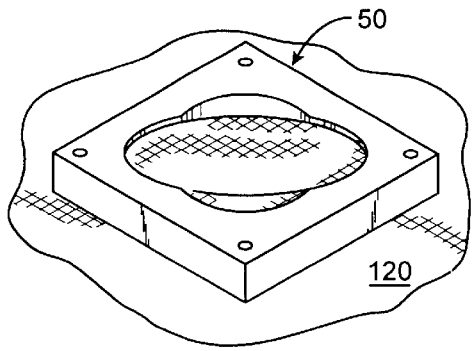

As shown in FIGS. 9A–9C, the same basic operation is preferably used to engage and hold a section of material 120 between the frame 50 and base 10. A section of material 120 to be held is positioned between the base 10 and the frame 50 as shown in FIG. 9A. As used herein, "material" refers to a wide variety of flexible fabrics, tarp, plastic sheets, tent materials, flexible webs and the like. The particular structure and make-up of the "material" is not important and is not intended to limit the invention. As shown in FIG. 9B, the frame and base are then oriented so that the first opening 70 of the frame and the flange 25 of the base are aligned, and the frame is placed over the base such that the flange 25 and a section of material 120 pass though the first opening 70. The frame 50 is then rotated to align the flange 25 with the second opening 75 thereby removably coupling the frame and base, and engaging and holding the section of material 120 therebetween. In this fashion, the section of material is engaged and held securely without piercing the material. If further tension between the frame and base is desired or necessary, the frame can be connected to a guide or tensioning line as previously described.

While the use of a preferred fastener according to the invention has been described with respect to only a single fastener, it is understood that a given application may require the use of numerous fasteners. Thus, for example, in a roofing application, it may be desirable to affix a number of bases 10 to a partially-completed roof structure. A tarp or other fabric to be held on the roof would then be placed in position, and a corresponding number of frames used to engage and hold the tarp in locations corresponding to the locations of the bases on the roof. By removing the frames as previously described, the tarp may be released from the fasteners and removed from the roof so work can continue. When it is no longer necessary or desirable to protect the roof with the tarp, the bases may be easily removed by unscrewing them from the roof structure, for example. Because neither the fasteners nor the tarp are damaged as a result of the fastening and unfastening process, they may be used repeatedly and without replacement.

What have been described are exemplary embodiments of a presently preferred fastener embodying the present invention and an exemplary method of use thereof.

Unless otherwise specifically indicated, the foregoing descriptions are not intended to limit the invention, the scope of which is intended to be defined by the appended claims. Persons skilled in the art will understand and appreciate that numerous variations may be made to the described embodiments, including but not limited to changing shapes, dimensions, and materials, all without departing from the spirit and scope of the invention, and while continuing to meet the objectives and provide the advantages which characterize the invention. Such variations are therefore intended to be emcompassed within the scope of the invention.

What is claimed is:

1. A removable fastener for holding a material, comprising:

a base having a first surface and having a geometrically-shaped protrusion spaced from said first surface;

a frame having a geometrically-shaped opening, said geometrically-shaped protrusion being freely moveable at least partially through said opening when said base and frame are in a first orientation and said geometrically-shaped protrusion being blocked from passing through said opening when said base and frame are in a second orientation in which said frame and base are engaged; and a seat formed in said fame adapted to engage said geometrically-shaped protrusion when said base and frame are engaged in said second orientation to prevent relative movement of said frame and base;

whereby a section of material may be removably engaged and held between said frame and base without piercing said material.

2. The removable fastener of claim 1 wherein said base includes a shaft for accommodating a fastener to affix said first surface of said base to a support structure.

3. The removable fastener of claim 1 wherein said first surface of said base includes a spike for affixing said base to a support structure.

4. The removable fastener of claim 1 wherein said geometrically-shaped protrusion comprises a substantially elliptical protrusion.

5. The removable fastener of claim 1 wherein said substantially elliptical protrusion comprises a flange.

6. The removable fastener of claim 1 wherein said frame includes connecting means.

7. The removable fastener of claim 1 wherein said geometrically-shaped opening substantially defines a first ellipse having a first orientation.

8. The removable fastener of claim 7 wherein said geometrically-shaped opening substantially defines a second ellipse having a second orientation.

9. The removable fastener of claim 8 wherein said geometrically-shaped openings substantially defining said first and second ellipses are substantially concentric.

10. The removable fastener of claim 8 wherein said geometrically-shaped opening substantially defining said second ellipse has a partial occlusion to block said geometrically-shaped protrusion from passing through said opening when said geometrically-shaped protrusion is substantially aligned with said geometrically-shaped opening substantially defining said second ellipse.

11. The removable fastener of claim 10 wherein said partial occlusion is located substantially at opposite elongate ends of said geometrically-shaped opening substantially defining said second ellipse.

12. The removable fastener of claim 10 wherein said geometrically-shaped protrusion comprises a substantially elliptical flange.

13. The removable fastener of claim 10 wherein said partial occlusion at least partially forms said seat.

14. A removable fastener for holding material, comprising:

a base having a first surface and a second surface comprising a substantially elliptical flange spaced apart from said first surface;

a frame having an outer frame section surrounding an interior opening, said opening substantially defining a first ellipse having a first orientation and a second ellipse having a second orientation, said second ellipse having a partial occlusion at opposite elongate ends thereof;

said substantially elliptical flange being free to pass through said interior opening when said base and frame are in a first orientation wherein said substantially elliptical flange and said opening substantially defining a first ellipse are aligned, and said substantially elliptical flange being blocked from passing through said interior opening when said base and frame are in a second orientation wherein said substantially elliptical flange and said opening substantially defining a second ellipse are aligned, said base and frame being removably engaged in said second orientation;

whereby a section of material may be removably engaged and held between said base and said frame without piercing said material when said frame and base are in said second orientation.

15. The removable fastener of claim 14 wherein said base is substantially cylindrical in shape and wherein said first and second surfaces are located at opposite ends thereof.

16. The removable fastener of claim 14 wherein said partial occlusion comprises a contiguous portion of said outer frame section.

17. The removable fastener of claim 16 wherein said substantially elliptical flange has a lower surface portion adapted to engage said contiguous portion of said outer frame section when said frame and base are removably engaged.

18. The removable fastener of claim 14 wherein said base includes a shaft for accommodating a fastener to affix said first surface of said base to a support structure.

19. The removable fastener of claim 14 wherein said first surface of said base includes a spike for affixing said base to a support structure.

20. The removable fastener of claim 14 wherein said frame includes connecting means.

21. A removable fastener for holding a material, comprising:

a first piece having a geometrically-shaped protrusion;

a second piece having a geometrically-shaped opening corresponding to said protrusion, said opening adapted to receive said protrusion in a first orientation and to cause said first and second pieces to be engaged in a second orientation; and a seat formed in said second piece adapted to engage said protrusion to prevent relative movement of said first and second pieces when engaged; wherein said seat extends inwardly from said geometrically-shaped opening of the second piece of said removable fastener;

whereby a section of material may be removably engaged and held between said first and second pieces when engaged without piercing said material.

22. The removable fastener of claim 21 wherein said seat has a geometric shape substantially corresponding to the geometric shape of said protrusion.

23. The removable fastener of claim 22 wherein said seat has an orientation corresponding to said second orientation.

24. The removable fastener of claim 23 wherein said seat has a first axis and said opening has a second axis and said seat and said opening are oriented so that said first and second axes are substantially perpendicular.

25. The removable fastener of claim 21 wherein said geometrically-shaped protrusion comprises a substantially elliptical protrusion.

26. The removable fastener of claim 25 wherein said geometrically-shaped opening has a substantially elliptical shape corresponding to said substantially elliptical protrusion.

27. The removable fastener of claim 26 wherein said seat has a substantially elliptical shape substantially corresponding to said substantially elliptical shape of said protrusion.

28. The removable fastener of claim 27 wherein said seat is oriented substantially orthogonally to said first substantially elliptical shape.

29. The removable fastener of claim 28 wherein said seat overlaps and extends across said opening.

30. The removable fastener of claim 29 wherein said shapes of said seat and said opening are substantially concentric.

* * * * *

UNITED STATES PATENT AND TRADEMARK OFFICE

CERTIFICATE OF CORRECTION

PATENT NO. : 6,718,600 B1
DATED : April 13, 2004
INVENTOR(S) : Robert E. Gillis

It is certified that error appears in the above-identified patent and that said Letters Patent is hereby corrected as shown below:

Column 7,
Line 42, change “fame” insert -- frame --.

Signed and Sealed this

Eighth Day of June, 2004

JON W. DUDAS
*Acting Director of the United States Patent and Trademark Office*